US005657000A

United States Patent [19]

Ellingboe

[11] Patent Number: 5,657,000

[45] Date of Patent: Aug. 12, 1997

[54] PERISTALTIC PUMP OCCLUSION DETECTOR AND ADJUSTER

[75] Inventor: Bruce S. Ellingboe, Littleton, Colo.

[73] Assignee: COBE Laboratories, Inc., Lakewood, Colo.

[21] Appl. No.: 456,651

[22] Filed: Jun. 2, 1995

[51] Int. Cl.[6] ..... G08B 21/00

[52] U.S. Cl. ..... 340/608; 128/DIG. 12; 128/DIG. 13; 417/63; 417/477.7; 604/67

[58] Field of Search ..... 340/607–611; 417/63, 477.7; 604/65–67; 128/DIG. 12, DIG. 13

[56] References Cited

U.S. PATENT DOCUMENTS

| | | | |
|---|---|---|---|
| Re. 24,420 | 1/1958 | Fielden | 324/455 |
| 315,667 | 4/1885 | Serdinko | 417/477 |
| 460,944 | 10/1891 | Burson | 417/477 |
| 487,136 | 11/1892 | Truax | 417/477 |
| 2,988,001 | 6/1961 | D'Arcey et al. | 417/476 |
| 3,079,868 | 3/1963 | Ormsby | 417/477 |
| 3,396,331 | 8/1968 | Sperry, III | 324/445 |
| 3,404,335 | 10/1968 | Kidder | 324/445 |
| 3,404,336 | 10/1968 | Rosenthal | 324/445 |
| 3,463,092 | 8/1969 | Meyer | 417/477.6 |
| 3,787,148 | 1/1974 | Kopf | 417/477 |
| 3,885,894 | 5/1975 | Sikes | 417/477 |
| 3,995,902 | 12/1976 | Kyvsgaard | 417/477 |
| 4,043,712 | 8/1977 | Azzolini | 417/477 |
| 4,138,639 | 2/1979 | Hutchins | 324/442 |
| 4,142,845 | 3/1979 | Lepp et al. | 417/477 |
| 4,174,193 | 11/1979 | Sakakibara | 417/477 |
| 4,256,437 | 3/1981 | Brown | 417/63 |
| 4,288,205 | 9/1981 | Henk | 417/477 |
| 4,363,609 | 12/1982 | Cosentino et al. | 417/477 |
| 4,373,525 | 2/1983 | Kobayashi | 417/63 |
| 4,444,546 | 4/1984 | Pazemenas | 417/63 |
| 4,522,571 | 6/1985 | Little | 417/476 |
| 4,548,553 | 10/1985 | Ferster | 417/477 |
| 4,568,255 | 2/1986 | Lavender et al. | 417/477 |
| 4,650,471 | 3/1987 | Tamari | 417/477 |
| 4,739,492 | 4/1988 | Cochran | 324/445 |
| 4,740,755 | 4/1988 | Ogawa | 324/445 |
| 4,836,752 | 6/1989 | Burkett | 604/67 |
| 4,995,268 | 2/1991 | Ash et al. | 604/67 |
| 5,049,047 | 9/1991 | Polaschegg et al. | 417/474 |
| 5,052,900 | 10/1991 | Austin | 417/477 |
| 5,082,429 | 1/1992 | Soderquist | 417/477 |
| 5,103,211 | 4/1992 | Daoud et al. | 340/608 |
| 5,342,180 | 8/1994 | Daoud | 417/474 |

FOREIGN PATENT DOCUMENTS

| | | |
|---|---|---|
| 0 521 184 A1 | 1/1993 | European Pat. Off. . |
| 1599090 | 7/1970 | France . |
| 831692 | 3/1960 | United Kingdom . |
| 2093192 | 8/1982 | United Kingdom . |

*Primary Examiner*—Jeffery Hofsass
*Assistant Examiner*—Daniel J. Wu
*Attorney, Agent, or Firm*—Bruce R. Winsor; Edna M. O'Connor

[57] ABSTRACT

An method and apparatus for determining a degree of occlusion in the tubing loop disposed in the raceway of a peristaltic pump. An electrical circuit is formed in tubing loop by filling the loop with an electrically conductive fluid, such as blood, and electrically connecting the inlet portion to the outlet portion of the tubing loop. An excitation coil, which encircles a portion of the tubing loop, induces an alternating current in the tubing fluid. A sensing coil, also encircling a portion of the tubing loop, senses the induced current. The degree if occlusion in the tubing loop is correlated to the magnitude of the sensed current. The degree of occlusion may be adjusted, in response to the determined occlusion, while the pump is in operation using an occlusion adjuster.

31 Claims, 11 Drawing Sheets

PERISTALTIC PUMP OCCLUSION DETECTOR AND ADJUSTER

FIELD OF INVENTION

The present invention relates to devices for detecting and adjusting occlusion in a fluid line, and more particularly relates to monitoring conductivity of a peristaltic pump's fluid line to thereby detect a degree of fluid line occlusion and adjusting the degree of occlusion to a predetermined value for a medical procedure.

BACKGROUND OF THE INVENTION

Peristaltic pumps are preferred for many procedures because they can pump fluid through tubing without exposing the fluid to contact with the tubing exterior or any of the pump components. This feature is particularly desirable in medical and laboratory procedures where maintaining the sterility of a fluid is often vital. A problem arises, however, where peristaltic pumps are used with biological fluids. Various biological fluids are damaged by excessive pressure. For example, placing blood under high pressure in an extracorporeal tubing system may result in the blood cells being crushed.

A peristaltic pump is a volumetric positive displacement pump that moves fluid through a tube by progressively compressing the fluid tube in one direction. A peristaltic pump typically comprises a housing having a semi-circular internal raceway for receiving a fluid tube and a rotating member mounted in the center of the semi-circle formed by the raceway. The rotating member generally has roller elements that compress the fluid tube against the raceway. When the roller elements compress the tube, they also exert pressure on the internal fluid. It is, therefore, desirable to set the roller elements, of the rotating member, to a position predetermined to efficiently move the fluid through the tube without damaging the fluid. It is important that any method used to ascertain this position not compromise the sterility of the tubing fluid.

A common method currently used to set degrees of occlusion in peristaltic pumps involves measuring the drop rate of a column of fluid through a tubing loop. The rate at which the fluid drops is proportional to the extent to which the tubing is occluded. The pump occlusion mechanism is then manually adjusted to achieve a specified drop rate which correlates to the desired degree of occlusion. The fluid used to determine the drop rate, and sometimes the tubing as well, is discarded. This method is time consuming and may require using tubing in addition to that already required for the procedure.

Furthermore, this drop rate method can only be carried out before the pump is employed in a procedure. Often the flexible tubing used with peristaltic pumps distorts or relaxes during a procedure. As a result, the degree of occlusion in the tubing of the preset system will also change. The current drop rate method does not allow occlusion degree variations to be monitored during the course of a procedure.

Other methods are known for measuring degrees of occlusion in peristaltic tubing during a course of a procedure. These methods typically include an occlusion indicator or an occlusion alarm that activates when a preset threshold is exceeded. These methods, however, do not allow for adjustment of the degree of occlusion once it has been detected.

Prior art attempts to improve occlusion detection in peristaltic pumps have included:

U.S. Pat. No. 5,103,211 (1992) to Daoud et al. discloses an apparatus for detecting pressure and occlusion in a fluid line. The disclosed fluid line is driven by a peristaltic pump. The rotating member of the pump has a plurality of fingers for exerting pressure on the line. One of the fingers is a sensor follower finger. A strain gauge, mounted on the sensor follower finger, generates a signal indicating the amount of force that the finger is exerting on the line. A signal processor, also mounted on the sensor follower finger, receives the signal and sounds an alarm if an occlusion is determined.

U.S. Pat. No. 5,049,047 (1991) to Polaschegg et al. discloses a peristaltic infusion pump with means for measuring the internal diameter of the associated fluid tube. Fluid infusion rate, in such a system, is dependent on the internal diameter of the pump tube. The Polaschegg ('047) invention uses either a mechanical compression system or an ultrasound system to measure the pump's internal tube diameter and adjust infusion rate accordingly.

U.S. Pat. No. 4,836,752 (1989) to Burkett discloses a device for detecting partial restrictions in an IV fluid line, where the fluid is driven by a peristaltic pump. The device comprises a gauge for detecting dimensional variations in the outside diameter of the fluid line. The device then correlates the dimensional variations with changes in the fluid pressure in the line. The device sounds an alarm when it detects a pressure corresponding to a preset threshold pressure.

U.S. Pat. No. 4,373,525 (1983) to Kobayashi discloses an apparatus and method for detecting occlusion in the fluid infusion tube of a peristaltic fluid-infusion pump. The Kobayashi ('525) invention detects changes in the distance between opposing walls of the fluid infusion tube, or in other words, the tube diameter. A change in the distance between the walls of fluid infusion tube reflects a change in the internal pressure. An increase in the fluid infusion tube's internal pressure correlates to an occlusion. One disclosed embodiment uses a bridge circuit, a sampling circuit, and a comparator to detect this change in infusion tube diameter.

It is known that the electrical conductance of a fluid in a tubing loop, comprising a closed electrical circuit of known cross sectional area and length, may be measured by inducing and sensing an alternating electrical current in the fluid. The magnitude of the induced current is proportional to the conductance of the fluid. A cell for measuring the conductance of a biological fluid without contacting the fluid in a closed non-metallic conduit is disclosed in U.S. Pat. No. 4,740,755 entitled "Remote Conductivity Sensor Having Transformer Coupling In A Fluid Flow Path," issued Apr. 26, 1988 to Ogawa and assigned to the assignee of the present invention, the disclosure of which is hereby incorporated, in its entirety, by reference.

At present, adjustment of occlusion amounts in peristaltic pumps is generally achieved manually or maintained through spring loaded roller elements. Present manual adjustment is time consuming and may only be carried out before a procedure is started. This is problematic because, as discussed above, tubing often relaxes or distorts during a procedure which requires that the roller position be adjusted to maintain the desired degree of occlusion.

Spring loaded rollers are also problematic. They tend to fully occlude the tubing which may excessively damage a biological fluid contained in the tube. This is a particularly serious problem during heart by-pass operations where a patient's blood is repeatedly circulated through a peristaltic pump.

The following exemplify prior art occlusion adjustment devices in peristaltic pumps:

U.S. Pat. No. 4,548,553 (1985) to Ferster discloses a peristaltic pump improvement that comprises a mechanism for externally controlling the position of the pump's rollers, thereby setting the pressure exerted by the roller on the tubing fluid to a desired level. The Ferster ('553) invention comprises two roller elements, positioned back-to-back and biased towards each other by a spring. The tip of an inverted cone is disposed between the roller element backs. The cone may directed downward manually by turning an adjusting screw. As the cone is adjusted downward, the roller elements are further biased outward, exerting increased pressure on the tubing and its fluid.

U.S. Pat. No. 3,463,092 (1969) to Meyer discloses a pump having a tube mounted around rotatable member. The tube is mounted under tension, thereby obviating the need for a raceway or internal arcuate wall. The rotating member comprises a number of rollers disposed in a circle around a inverted conical nut. The rollers may be balls.

As the nut is displaced downward the balls are radially biased outward, thereby exerting increased pressure on the tube and its internal fluid.

U.S. Pat. No. 3,955,902 (1976) to Kyvsgaard, U.S. Pat. No. 4,174,193 (1979) to Sakakibara, and U.S. Pat. No. 4,522,571 (1985) to Little all disclose peristaltic pumps having raceways with angled interior walls and correspondingly angled roller elements. All of the above inventions comprise means for manually adjusting the size of the gap between angled interior walls of the raceway and the roller elements, thereby adjusting the pressure exerted on the associated tubing and its fluid.

U.S. Pat. No. 4,568,255 (1986) to Lavender et al. discloses a peristaltic pump having a single cam, mounted between rotor and pump arms. The position of both pump arms may be simultaneously adjusted by manually rotating the cam via an attached knob.

U.S. Pat. No. 3,885,894 (1975) to Sikes discloses a peristaltic pump in which the roller elements are spring biased toward the raceway walls. The roller elements are, simultaneously, limited with respect to how close they may approach the race way walls. An adjustable stop sets a predetermined minimum gap between the race way walls and the roller elements. The Sikes ('894) invention allow the roller elements to self-adjust, to the extent of the preset minimum gap, to tubing variations.

Further prior art patents of interest that teach various means of adjusting roller position and, therefore, tubing occlusion in peristaltic pumps include: U.S. Pat. No. 315,667 (1885) to Serdinko in which roller position is adjusted by thumb screws. U.S. Pat. No. 460,944 (1891) to Burson in which roller position is adjusted via a gear wheel. U.S. Pat. No. 487,136 (1892) to Truax in which roller position is adjusted by turning a disc which engages the roller arms. U.S. Pat. No. 3,079,868 (1963) to Ormsby in which roller position may be adjusted by turning a screw which then engages a compression spring which then directs the roller towards the race way wall. U.S. Pat. No. 3,787,148 (1974) to Kopf in which rollers are drawn inward away from the tubing, when a slot cam is rotated clockwise.

The following prior art peristaltic pump improvements may also be of interest:

U.S. Pat. No. 5,052,900 (1991) to Austin discloses a pressure relief valve for positive pressure pumps, such as peristaltic pumps. The valve comprises a piece of bypass tubing connecting the outlet end of a tubing loop to the inlet end. A pressure limiting device is centered on the bypass tubing. The pressure limiting means consists of two bars placed on opposing sides of the bypass tubing and connected at their ends by elastic bands. When the bypass tubing contains enough fluid to exert sufficient pressure, the bars are displaced away from each other allowing the fluid to flow from the outlet to the inlet region of the tubing.

U.S. Pat. No. 4,650,471 (1987) to Tamari discloses a flow regulating device for a peristaltic pump that comprises an outer tube that surrounds the inner flexible fluid containing tube, thereby forming a chamber. The outer tube contains at least two access ports communicating with the inner chamber. Pressure gauges, occlusion regulating devices, alarm systems and other such devices can be attached to the access ports.

The present invention offers many advantages over the prior art. Many prior art occlusion detectors may only detect and adjust occlusion at the outset of a procedure, but not while the peristaltic pump is in motion. This is a problem because often during the course of a procedure the shape of the tubing distorts; therefore, a degree of occlusion set at the outset of a procedure will under or over occlude the distorted tubing during the course of a procedure. Additionally, the degree of occlusion may not be changed at will in prior art pumps during the course of a procedure.

Furthermore, many prior art pumps require lengthy set up times. In prior art pumps lacking retractable rollers, it is difficult to load the tubing into the pump raceway during pump set up. Additionally, many prior art pumps require extra tubing to set the desired degree of occlusion at the outset of the procedure.

SUMMARY OF THE INVENTION

A significant aspect of the present invention is a method and apparatus for noninvasively detecting occlusion in the flexible tubing loop of tubing disposed in the raceway of a peristaltic pump by remotely monitoring the conductivity of the fluid contained in the tubing. In accordance with this aspect of the invention, a circuit is formed in the fluid loop by connecting the inlet portion of the loop with the outlet portion to form an electric circuit. An excitation coil is wrapped around the tubing loop down stream of the inlet and upstream of the outlet. A sensing coil is wrapped around the tubing loop downstream of the excitations coil and upstream of the outlet. The excitation coil and sensing coil are connected to a remote occlusion detector which includes a alternating current source and a sensor. The excitation coil induces an alternating current in fluid of the tubing which in turn induces an alternating current in the sensing coil. The sensor calculates the fluid conductance based on the alternating current induced in the sensing coil. The fluid conductance is proportional to the magnitude of the induced current in the fluid and, therefore, the induced current in the sensing coil. A large decrease in fluid conductance correlates to full occlusion in the tubing loop. The apparatus may be calibrated to correlate the magnitude of fluid conductance to the degree of tubing occlusion.

Another significant aspect of the present invention is a method and apparatus for automatically adjusting the degree of occlusion in the flexible tubing loop of a peristaltic pump in response to the remotely detected occlusion. In accordance with this aspect of the invention, the sensor of the remote occlusion detector reports fluid conductance or occlusion to a controller, preferably a micro processor. When full occlusion is detected, the controller instructs an actuator to retract the pump roller elements to occlude the tubing by a predetermined optimal amount.

Another significant aspect of the present invention is a manual occlusion adjuster for manually adjusting the degree of occlusion in response to the remotely detected occlusion.

Another significant aspect of the present invention is an occlusion adjuster in which a conical cam is displaced by a predetermined distance to adjust occlusion by a predetermined degree.

Another significant aspect of the present invention is a method and apparatus for remotely detecting occlusion during the course of a medical procedure.

Another significant aspect of the present invention is a method and apparatus for adjusting occlusion during the course of a medical procedure.

Another significant aspect of the present invention is a method and apparatus that allows the peristaltic pump rollers to be retracted allowing easy and quick loading of the tubing during the pump set up.

Another significant aspect of the present invention is a manual override mechanism for adjusting a degree of occlusion when power is removed from the system for any reason.

Another significant aspect of the present invention is a method and apparatus that provides a means for automatically driving the rollers to fully occlude the tubing loop whenever the peristaltic pump is stopped, thereby preventing the potentially hazardous backward flow of the tubing fluid.

Other significant aspects of this invention will appear from the following description and appended claims, reference being had to the accompanying drawings forming a part of this specification wherein like reference characters designate corresponding parts in the several views.

DETAILED DESCRIPTION OF THE INVENTION

Structure

Figure 1:
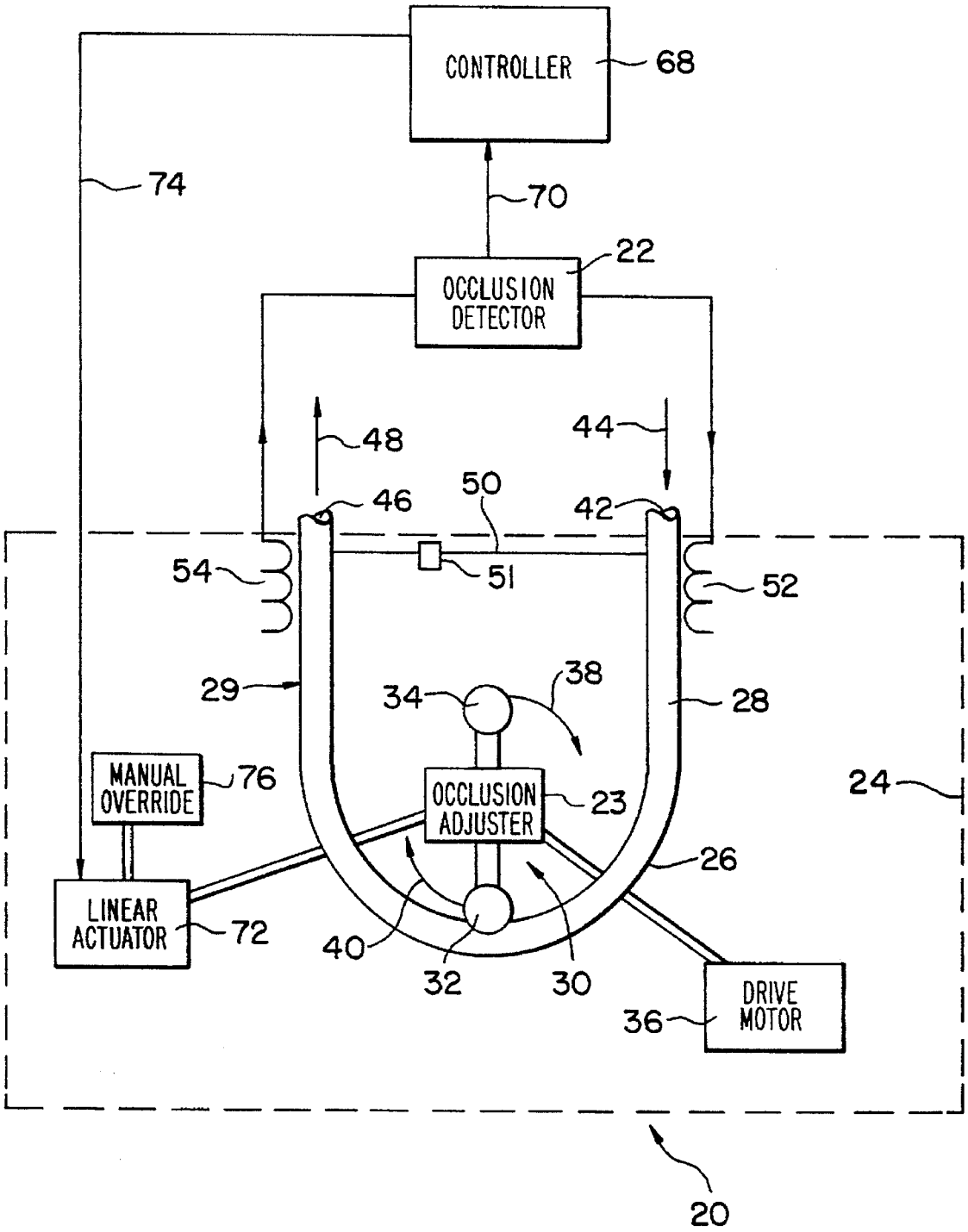
FIG. 1 is a block diagram illustrating a peristaltic pump incorporating a remote occlusion detector and an occlusion adjuster in accordance with the first preferred embodiment of the present invention.

FIG. 1 illustrates a peristaltic pump 20 incorporating a remote occlusion detector 22 and an occlusion adjuster 23 in accordance with the present invention. The peristaltic pump 20 comprises a housing 24 having an internal semi-circular raceway 26 (shown in FIG. 5) for receiving a flexible tubing loop 28 having a predetermined cross sectional area. A rotor assembly 30, having at least two roller elements 32, 34, is mounted in the center of the semi-circle formed by the raceway 26 such that the roller elements 32, 34 may be brought into contact with the tubing loop 28. The rotor assembly 30 may rotate in either the clockwise or counter clockwise direction and may be powered by a conventional drive motor 36. The conventional drive motor 36 may be any one of several well known types, including a D.C. servo motor which gives a wide speed range and high peak torque.

FIG. 1 illustrates the configuration of the present invention when the rotor assembly 30 rotates in a clockwise direction as denoted by rotation direction arrows 38, 40. When the rotor assembly 30 travels in a clockwise direction, fluid enters the tubing loop 28 at an inlet 42, denoted by an inlet direction arrow 44, is moved through the loop 28 by the roller elements 32, 34, and exits through the tubing outlet 46 denoted by an outlet direction arrow 48. It should be appreciated that the present invention will function in substantially the same way if the rotor assembly 30 rotates in the counter clockwise direction and the inlet 42 and outlet positions 46 are correspondingly adjusted. Further, a single pump may have a rotor assembly 30 that rotates in a clockwise direction during certain portions of a procedure and a counter clockwise direction during other portions of the procedure without altering the present invention.

The tubing loop 28 comprises a portion of an extracorporeal tubing set 29 used in medical procedures such as open heart surgery, dialysis, apheresis, and autologous blood salvage. The extracorporeal tubing set 29 may also be used with blood treatment devices comprising a membrane exchange device or centrifugal separation device. As is well know in the art, it is highly desirable that all portions of the tubing set be disposable when used with living beings to prevent cross contamination between individual beings. Disposable tubing sets for use with the present invention may be formed from a plurality of plastic or elastomeric tubes, connectors, needles, and medical devices that are well known in the art.

A shunt 50 must be incorporated in the tubing loop 28 of the extracorporeal tubing set to facilitate use of the tubing set with the present invention. A shunt 50 electrically connects the inlet portion 42 with the outlet portion 46 of the tubing loop 28. The shunt 50 may be a piece of conductive wire or a piece of tubing connecting the fluid between the inlet 42 and outlet 46 portions of the tubing loop 28. This configuration of the tubing loop 28 creates an electrical path, when the loop is filled with a conductive fluid, having a predetermined cross sectional area and path length. When blood, or another conductive biological or medical fluid enters the tubing loop, it may fill both the tubing loop 28 and the connective tubing shunt 50 to form an electrical circuit. A valve 51 may be used to shut off the fluid flow when occlusion is not being monitored. Alternatively, the fluid may only fill the tubing loop 28 and the shunt 50 may simply be a wire, in contact with the fluid at the inlet portion 42 and the outlet portion 46 that unites the tubing loop 28 into an electrical circuit.

Figure 2:
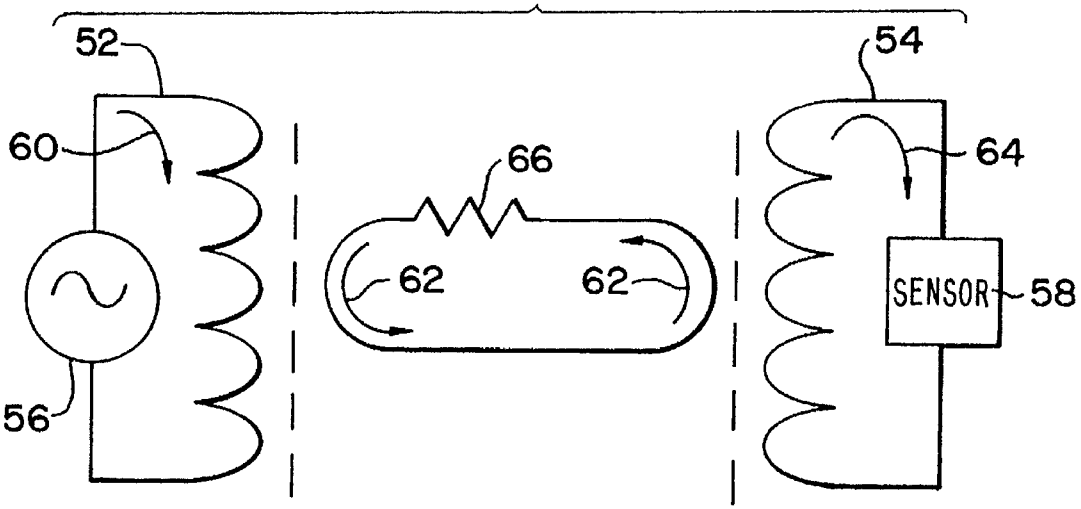
FIG. 2 is a simplified schematic diagram of the electric circuit formed by the first preferred embodiment of the present invention's closed fluid loop and its excitation and sensing coils.

The remote occlusion detector 22 is connected to the fluid loop 28. The remote occlusion detector 22 comprises an excitation coil 52 encircling the tubing loop 28 at a location separate from the location of a sensing coil 54 which also encircles the tubing loop 28. In the preferred embodiment, the excitation coil 52 is positioned downstream of the inlet 42, the sensing coil 54 is positioned upstream of the outlet 46. An electrical circuit, as illustrated schematically in FIG. 2 is thereby formed. As will be appreciated by those skilled in the art, the relative locations of the sensing coil 54 and the excitation coil 52 may be reversed or changed in any number of way without affecting the functionality of the occlusion detector. It is important, however, that the sensing coil 54 and the excitation coil 52, be located to reduce the direct induction of current in the sensing coil 54 by the current in the excitation coil 52 to an acceptable level.

Referring to FIGS. 1 and 2, the remote occlusion detector 22 further comprises an energy source 56, such as an oscillator, for producing a periodically changing electrical current such as an alternating current and a sensor. 58 for detecting an induced current. When the energy source 56 causes an alternating current to flow in the excitation coil 52, illustrated by a conventional current direction arrow 60, a changing magnetic field is generated causing an electrical current to flow, as denoted by tubing conventional current direction arrow 62, in the fluid of the tubing loop 28. The magnitude of the induced current 62 is proportional to the conductance of the fluid in the electrical circuit show in FIG. 2. The circuit. conductance is illustrated b a schematic resistor 66.

The induced tubing current 62, in turn, generates a changing magnetic field at the location of the sensing coil 54. This changing magnetic field induces a sensed current, illustrated by a conventional current direction arrow 64, in the sensing coil 54. The sensed current 6 is delivered to sensor 58. The sensor 58 determines the circuit conductance 66 from the magnitude of the sensed current 64. The circuitry for conductivity measurement and calibration may be similar to that set forth in the Ogawa patent incorporated by reference above or other current magnitude measuring circuitry as are well known in the art.

A large decrease in circuit conductance 66 correlates to full occlusion of the tubing loop 28. The occlusion detector 22 may also be calibrated such that the magnitude of measured fluid conductance 66 correlates to the magnitude of the tubing occlusion. FIG. 1 illustrates a preferred embodiment Of the present invention, where the fluid conductance 66 is reported to a controller 68, as denoted by a signal arrow 70. In response, the controller 68 may instruct a linear actuator 72 to engage the occlusion adjuster 23, as illustrated by a signal arrow 74. The occlusion adjuster 23 varies the radial positions of the roller elements 32, 34; thus adjusting the degree of tubing occlusion. The controller 68 may comprise a microprocessor with suitable input/output adapters as are well known in the art. The controller 68 may also comprise an analog circuit. A preferred embodiment may further comprise a manual override 76 allowing occlusion to be manually adjusted in case of system failure or as otherwise necessary.

Figure 3:
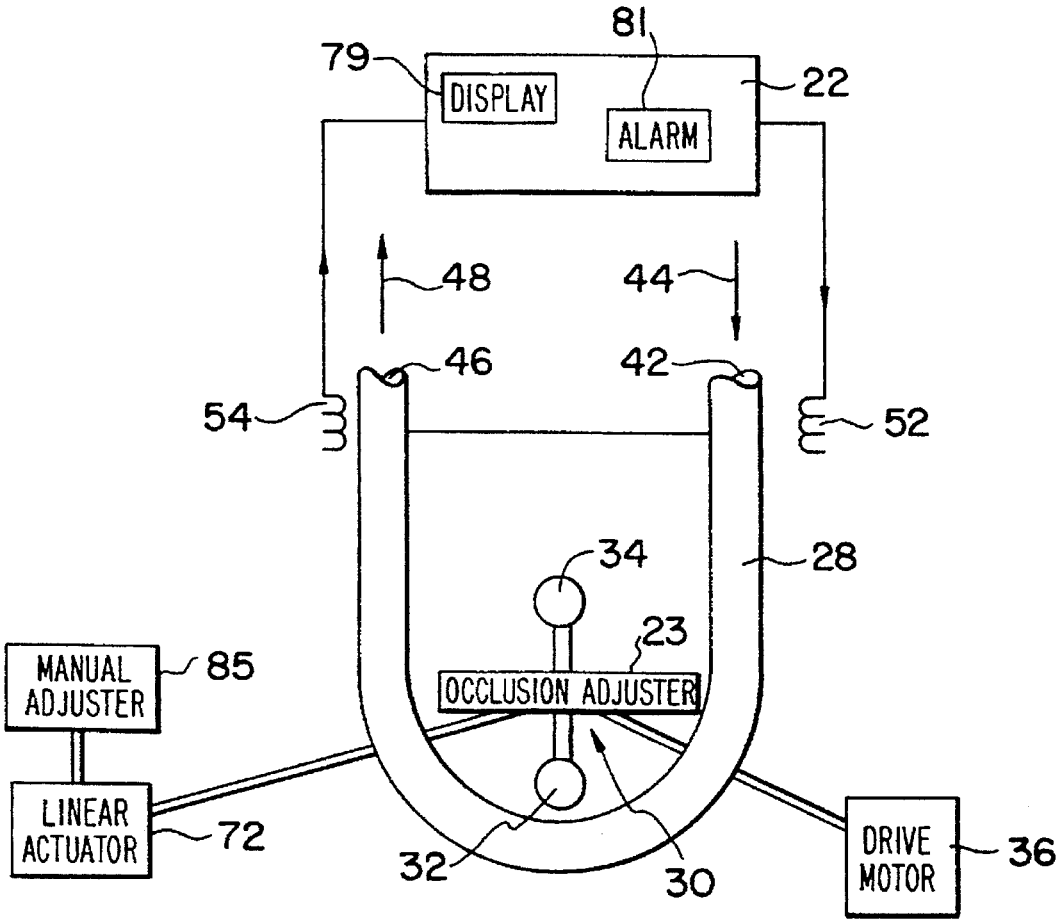
FIG. 3 is a block diagram illustrating a second preferred embodiment of the present invention in which the occlusion adjustor is manually operated.
Figure 4:
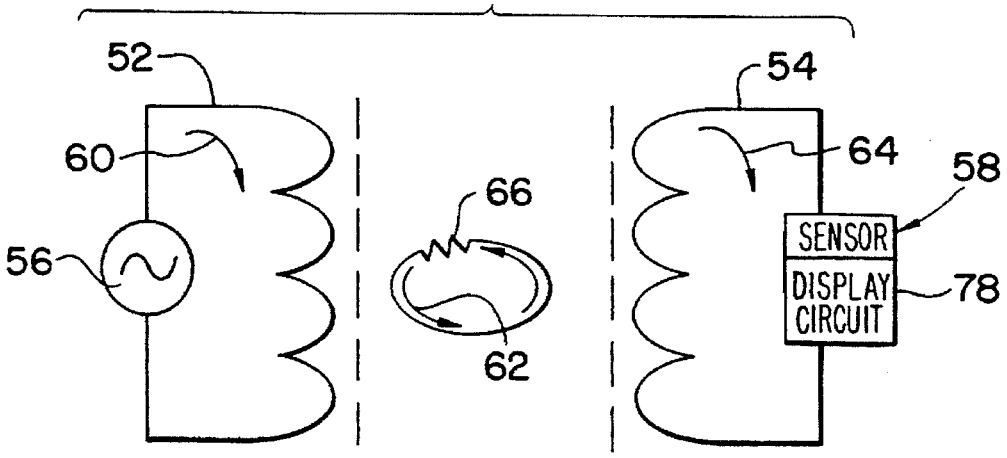
FIG. 4 is a schematic diagram of the electric circuit formed by the second preferred embodiment's closed fluid loop, excitation and sensing coils.

In an alternate preferred embodiment as shown in FIGS. 3 and 4, the sensor 58 may further comprise a sensing logic and display circuit 78 for receiving and interpreting the sensed current 64. In this embodiment, the sensor 58 does not report to the controller 68. In this second preferred embodiment, the sensor activates a display 79 or alarm 81 to notify a pump user that the tubing 28 is occluded or to display information corresponding to a degree of tubing occlusion. The pump user may then manually operate the occlusion adjuster 23, using the manual adjuster 85 to engage the linear actuator 72 to return the tubing occlusion to a predetermined amount.

It will be apparent to those skilled in the art that the sensing logic and display circuit 78 may use analog or digital circuit devices and other calculation algorithms may be used to calculate fluid conductance 66. Additionally, the fluid conductance 66 may be calculated in real time, as well as storing the necessary data for later use.

Turning now to FIGS. 5 through 13, the occlusion adjuster 23 is fixed to the rotor assembly 30. The occlusion adjuster 23 comprises a conical cam 80 (best illustrated in FIGS. 7 through 9) for adjusting the position of the roller elements 32, 34. The position of the conical cam 80 and, consequently, the position of the roller elements 32, 34 may be varied manually or by the controller 68 via the linear actuator 72, as noted above.

Figure 5:
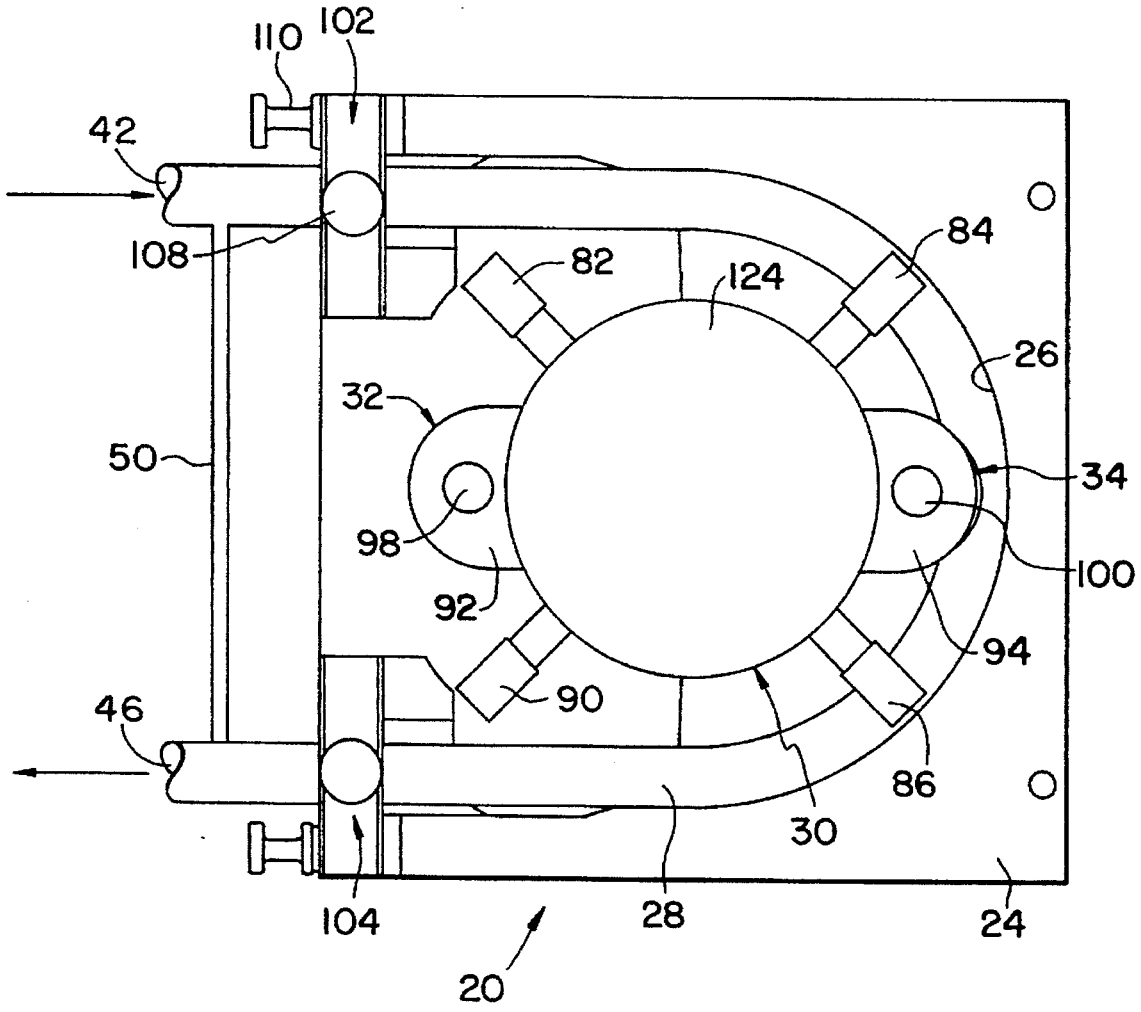
FIG. 5 is a plan view of a loop of tubing disposed within the raceway, around the rotating assembly and through the tubing clamps which contain the excitation and sensing coils of either embodiment of the present invention.

FIG. 5 shows a plan view of the pump 20 having the roller element 34 partially occluding the tubing loop 28 against the semi-circular raceway 26. Tubing guide post pairs 82, 84, 86, 90 (lower post shown in FIG. 9) maintain the tubing loop 28 in the proper orientation along the semi-circular raceway 26. The roller elements 32, 34 are symmetrically positioned on the rotor assembly 30. Where there are two roller elements 32, 34 they are relatively positioned 180 degrees apart on rotor assembly 30. A pair of yokes 92, 94 connect the roller elements 32, 34 to the rotor drive shaft 80. The roller elements 32, 34 are held in position on yokes 92, 94 by axles 98, 100 respectively. The roller elements 32, 34 may freely rotate around axles 98, 100.

A first tubing clamp 102 holds the tubing loop 28 in position within the peristaltic pump 20 at its inlet 42. A second tubing clamp 104 holds the tubing loop 28 at its outlet 46. The excitation coil 52 (FIG. 1) may be incorporated into the tubing clamp 102 and a portion of the pump housing 24. Correspondingly, the sensing coil 54 (FIG. 1) may be incorporated into the tubing clamp 104 and a portion of the pump housing 24.

Figure 6:
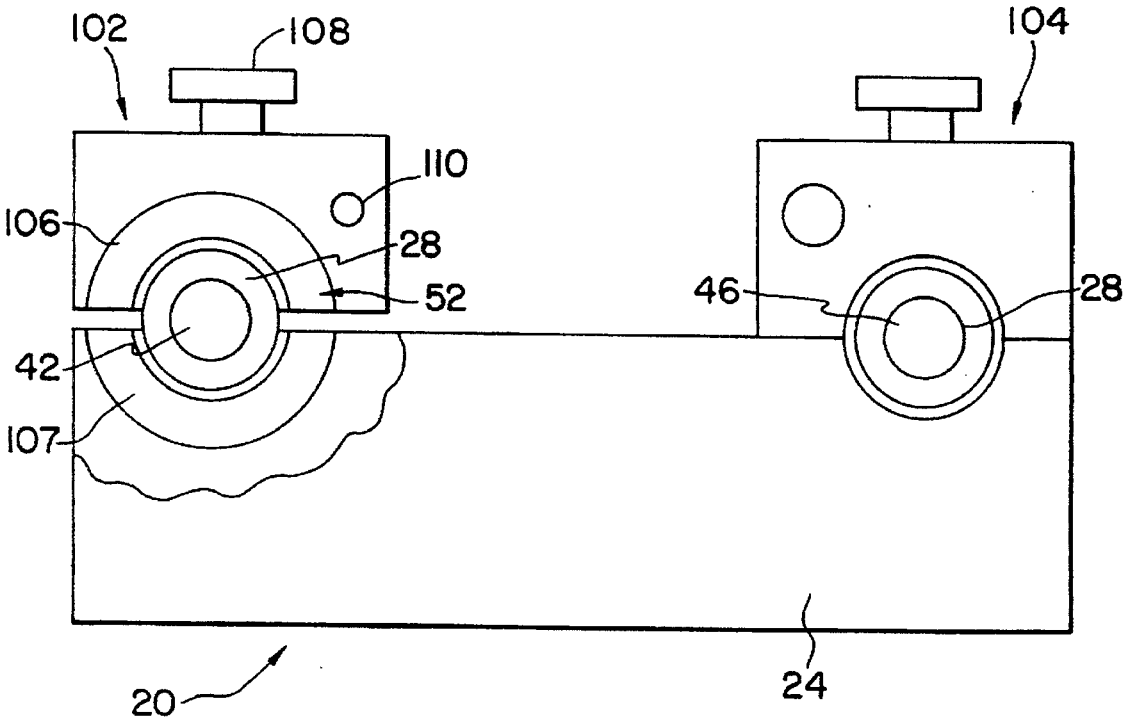
FIG. 6 is a front cut away view of a tubing clamp and housing portion, of either embodiment, exposing the excitation coil disposed inside the tubing clamp and pump housing.

Referring to FIG. 6, a partial cut away view of the excitation coil 52 incorporated into the first tubing clamp 102 and the housing 24 is shown. An upper half 106 of the excitation coil 52 is disposed with in the tubing clamp 102. A lower half 107 of the excitation coil 52 is disposed within the housing 24 of the pump 20. When two fastening screws 108, 110 are fully rotated inward, the two halves 106 and 107 of the excitation coil 52 contact each other to fully encircle the inlet portion 42 of the tubing loop 28. The sensing coil 54 may be incorporated into the housing 24 and tubing clamp 104 to encircle the outlet portion 46 of the tubing loop 28 in the same fashion.

The excitation coil 52 and sensing coil 54 each may comprise a wire wrapped torroidal core (not shown) of ferrite, as set forth in the Ogawa patent incorporated herein by reference. The excitation coil 52 and sensing coil 54 are electrically connected to other components of the remote occlusion detector, with wire interconnections, as schematically illustrated in FIG. 1 and 2.

Figure 7:
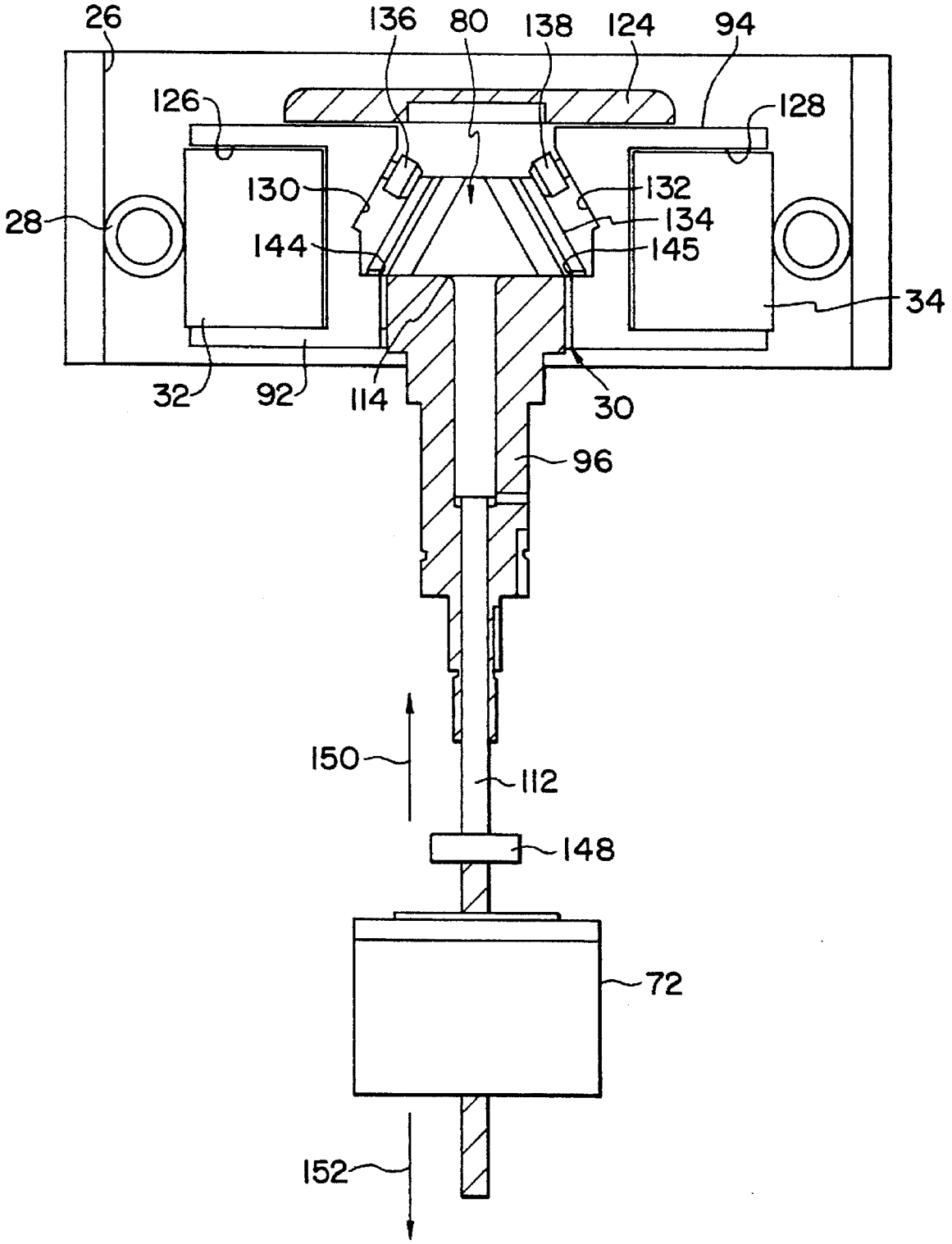
FIG. 7 is a front sectional view of the present invention's conical occlusion adjuster disposed within the peristaltic pump's race way having the rollers in the fully retracted position.
Figure 8:
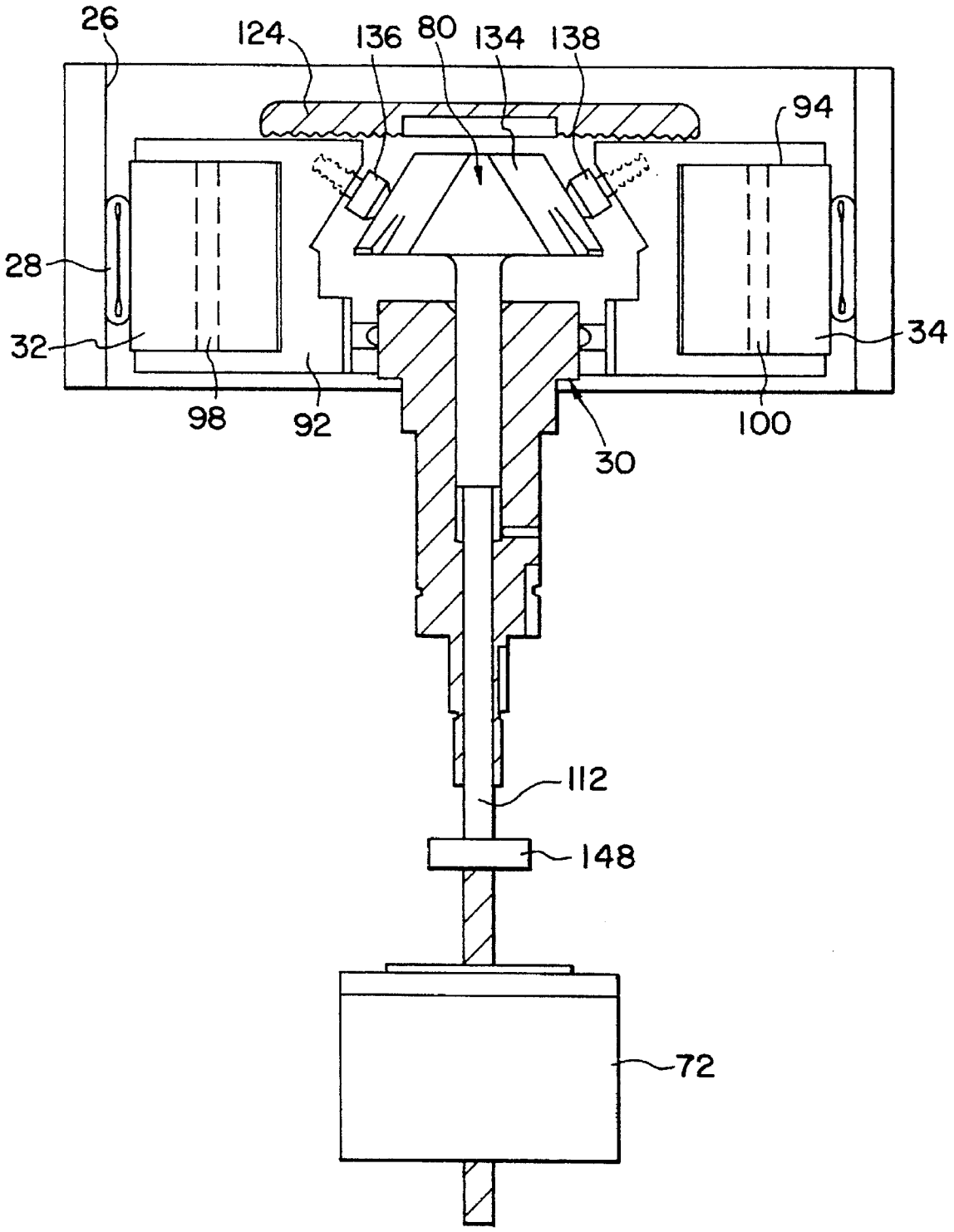
FIG. 8 is a front sectional view of the present invention's conical occlusion adjuster disposed within the pump raceway having the rollers extended to fully occlude the tubing.

Referring next to FIGS. 7 and 8, front sectional views are shown of the conical cam disposed within the rotating assembly 30. FIG. 7 shows the rotating assembly 30 with its roller elements 32, 34 fully retracted such that the tubing loop 28 is not occluded. FIG. 8 shows the rotating assembly 30 with its roller elements 32, 34 fully extended thereby fully occluding the tubing loop 28 against the pump raceway 26.

Figure 9:
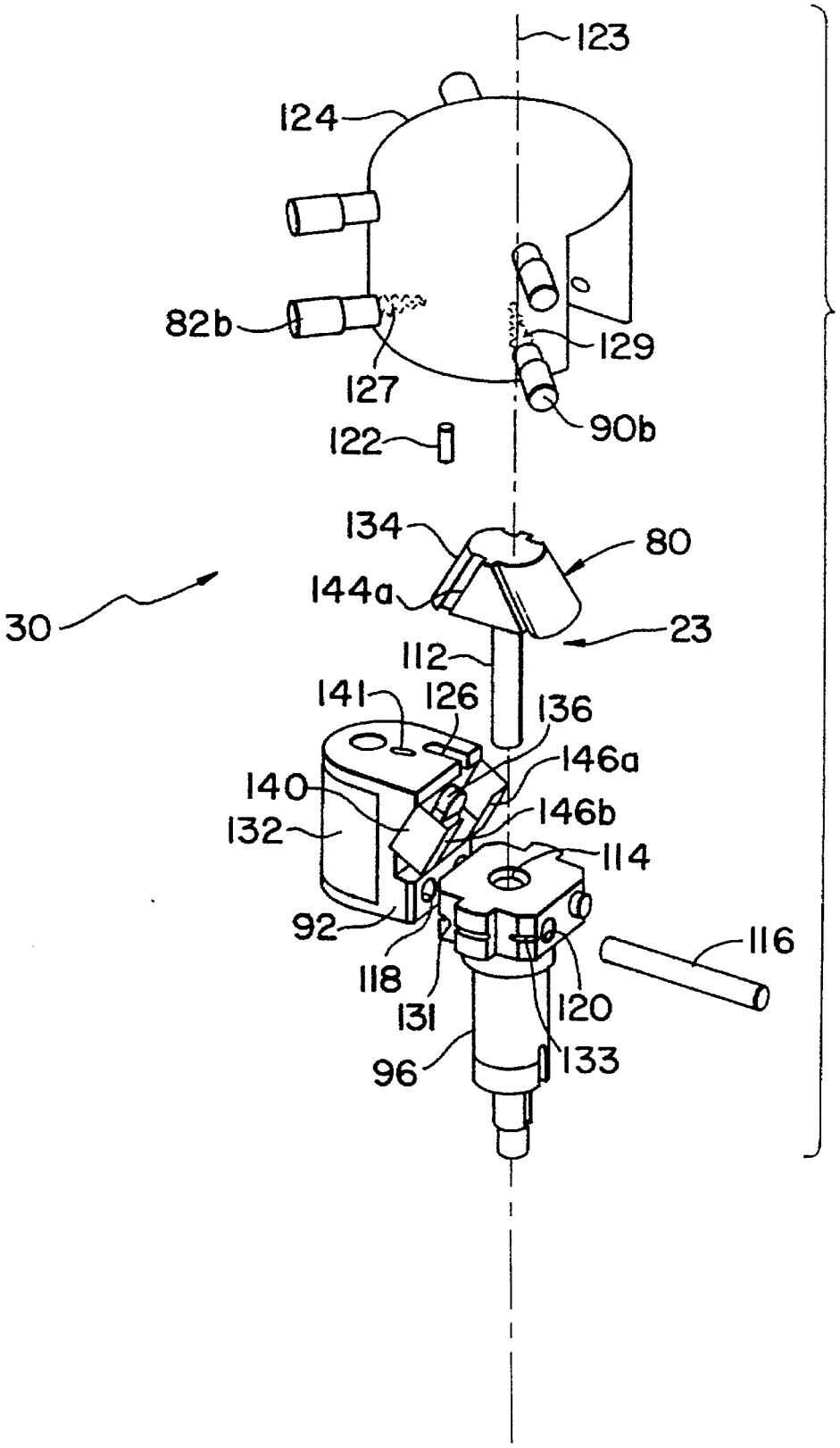
FIG. 9 is a perspective view of a partially assembled occlusion adjuster of either embodiment of the present invention.

Referring also to FIG. 9, a perspective view illustrates how various components of the rotor assembly 30 fit together. The occlusion adjuster 23 comprises a conical cam 80 fixed to a cam shaft 112. The cam shaft 112 fits into a receiving cavity 114 of the rotor drive shaft 96. There is very little clearance between the cam shaft 112 and the inner surface of the rotor drive shaft's receiving cavity 114. This minimal clearance prevents the cam shaft 112 from wobbling in the receiving cavity 114; therefore, the cam shaft 112 is stabilized in the receiving cavity 114 of the rotor drive shaft 96.

The yokes 92, 94 may each be slidably fixed to the rotor drive shaft 96 by a pair of connecting means. FIG. 9 illustrates a pair of connecting means with respect to one yoke 92. Of course, the same connecting configuration will be used with the second yoke 94.

The first connecting means, includes a dowel pin 116 fixed to the yoke 92 by pressing the dowel pin 116 into a yoke cavity 118. The dowel pin 116 may ride in a close tolerance aperture 120 in the rotor drive shaft 96. The dowel pin 116 slides through the aperture 120 when the yoke 92 is displaced outward or retracted inward. The second connecting means includes a second dowel pin 122 which may be fixed to the bottom of the rotor cap 124. The second dowel pin 122 slides along channel 126 when the yoke 92 is displaced outward or retracted inward. The second dowel pin 122 acts to constrain yoke travel perpendicular to rotor drive shaft's longitudinal axis 123, thereby preventing rotation about the first dowel pin 116.

The rotor cap 124 is connected to the rotor assembly 30 by threaded screws 127, 129 disposed behind tubing guide posts **82*b* and 90*b*, that engage the grooves 131, 133 of the drive shaft 96. The drive motor 36 (schematically shown in FIG. 1) rotates the rotor drive shaft 96 and thus, the entire rotor assembly 30**.

Referring also to FIGS. 7, 8, 9 and 10, the yokes 92, 94 are substantially rectangular in shape. Both yokes 92, 94 include an outer surface that faces the pump raceway 26 and an inner surface that faces the conical cam 80. The outer surfaces of yokes 92 and 94 each further comprise a substantially rectangular recess 126, 128 for receiving a roller element 32, 34. Roller elements 32, 34 are mounted in yokes 92, 94 as discussed in reference to FIG. 5. The upper inner surfaces 130, 132 of yokes 92, 94 are angled to correspond to an angled outer surface 134 of the conical cam 80. Each upper inner surface 130, 132 further comprises a cam follower 136, 138 and a flexible bracket 140, 142. The cam followers 136, 138 slide along the angled cam surface 134 to displace the yokes 92, 94 and, therefore, the roller elements 32, 34. The cam followers 136, 138 are adjustably mounted to the yokes 92, 94 as shown for follower 136 in FIG. 10. The position of the follower 136 may be adjusted to correspond to the position of the follower 138 by a screw 139 which is accessible for adjustment through aperture 141. Conversely, the cam followers 136, 138, themselves, may be threaded as shown in FIG. 8.

Both the conical cam 80 and the cam followers 136, 138 should be constructed of different high strength materials to prevent fretting corrosion which occurs when two mating parts of the same material are subjected to an oscillating load. Such materials may include steel, bronze or brass. The conical cam 80 may comprise hardened steel with a hard plating, such as chrome or nickel.

Figure 10:
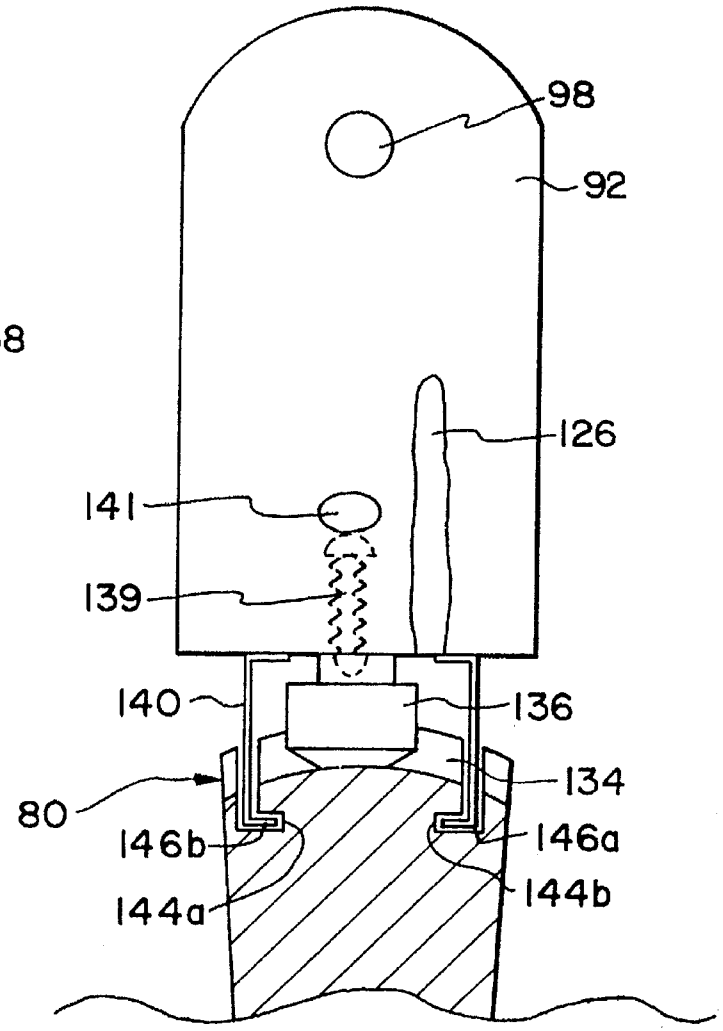
FIG. 10 is a plan view of one yoke assembly comprising a flexible bracket and cam follower where the flexible bracket is engaging the corresponding groove pair etched in the conical cam's surface.

FIG. 10 shows a plan view of the bracket 140 engaging a groove pair 144 etched in the surface 134 of the conical cam 80. The bracket's outer edges **146*a*, 146*b* are bent inward for slidably engaging the grooves 144*a*, 144*b* in the surface 134 of the conical cam 80. The brackets 140, 142 act to hold the cam followers 136, 138 against the slanted surface 134 of the conical cam 80. The brackets 140, 142 should be made of flexible material that allows the brackets 140, 142 to flex when the cam followers 136, 138 push the yokes 92, 94 toward the wall of the raceway 26 and to return to their original configuration, as shown in FIG. 10 for the bracket 140, when the yokes 92, 94 are in a retracted position. The brackets 140, 142 may be made of a hardened stainless steel having a high yield stress so that the brackets 140, 142 do not plastically deform when the yokes 92, 94** are deflected outward.

Referring again to FIGS. 7 and 8, a linear actuator 72 connects to the distal end of the cam shaft 112 through a thrust bearing 148. The thrust bearing 148 acts to allow the conical cam 80 to rotate freely with the rotor assembly 30 while allowing the linear actuator 72 to remain stationary. The linear actuator 72 may be any device capable of moving the conical cam 80 via its cam shaft 112 in a straight line path. The linear actuator 72 may be a manual device, such as a conventional screw, in the second preferred embodiment or it may be automated. The first preferred embodiment of the present invention may use a conventional stepper motor 143 as its linear actuator as best seen in FIG. 72.

The linear actuator 72 may move the conical cam 80 in an upward straight line path towards the pump rotor cap 124, as indicated by the direction arrow 150. FIG. 8 depicts the conical cam 80 extended upward towards its rotor cap 124. The cam followers 136, 138 slide down the slanted conical cam 80 as the cam 80 is displaced upward. As the cam followers 136, 138 slide downward, the circumference of the conical cam 80 that contacts the cam followers 136, 138 increases; thus, displacing the cam followers 136, 138 and correspondingly, the yokes 92, 94 and roller elements 32, 34 increasingly outward. As the roller elements 32, 34 are displaced outward, they increasingly compress the tubing loop 28 against the raceway 26 until the tubing loop 28 is fully occluded as shown in FIG. 8.

Conversely, the linear actuator 72 may move the conical cam 80 in a downward straight line path away from the pump rotor cap 124, as indicated by a direction arrow 152. As the conical cam 80 moves downward, the cam followers 136, 138 move up the slanted surface of the conical cam 80. As the cam followers 136, 138 move up the slanted surface of the conical cam 80, the circumference of the conical cam 80 that contacts the followers 136, 138 decreases; thus, allowing the cam followers 136, 138 and, correspondingly, the yokes 92, 94 and roller elements 32, 34 to retract inward until the tubing loop 28 is no longer occluded as shown in FIG. 7. Of course, the cam 80 may be positioned at any intermediate position whereby the yokes 92, 94 and roller elements 32, 34 are held in an intermediate position and the tubing loop 28 is partially occluded.

Figure 11:
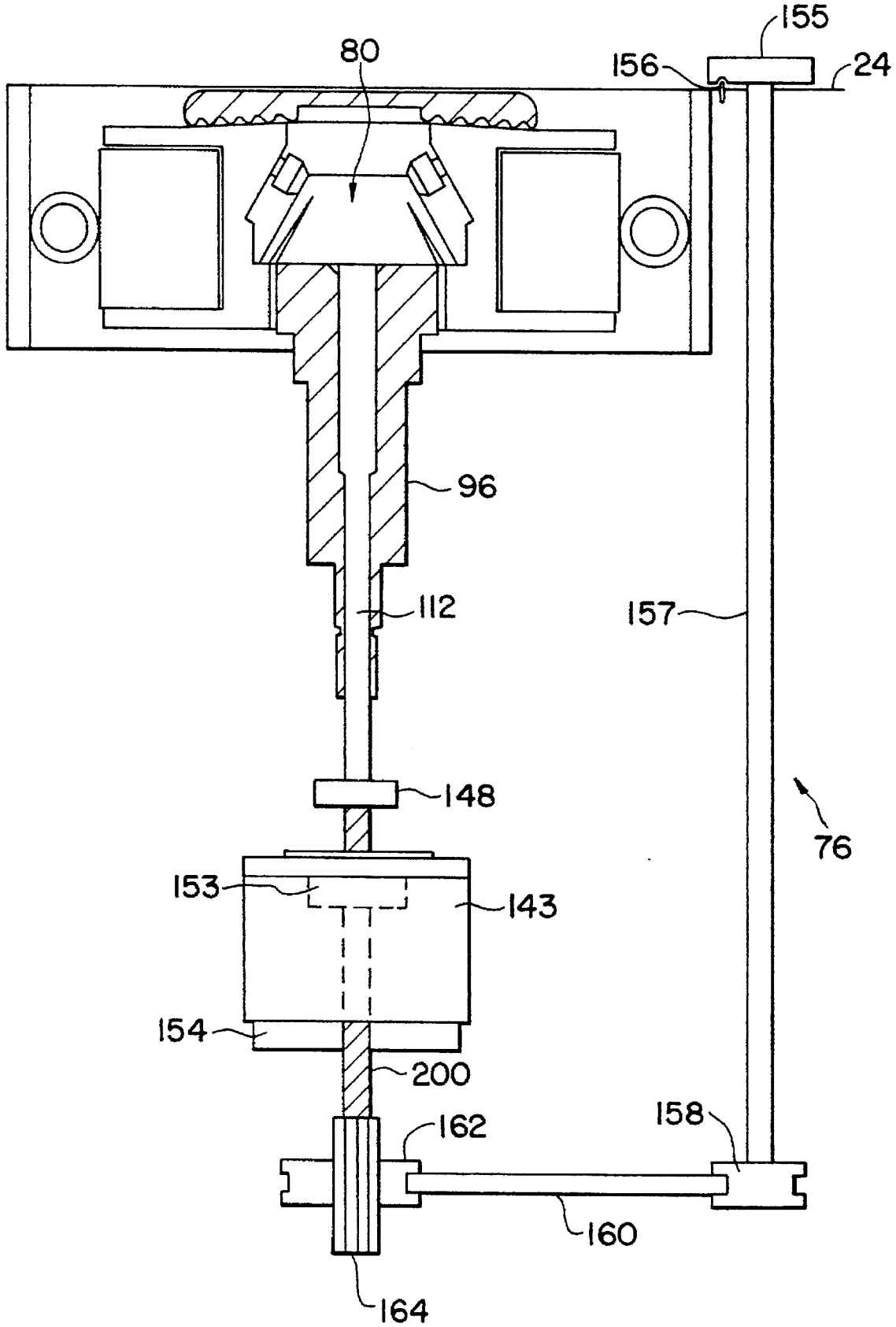
FIG. 11 is a front sectional view of the manual override mechanism of the first preferred embodiment of the present invention.

Referring to FIG. 11, a manual override 76 may be mounted parallel to the linear stepper motor 143 to adjust occlusion in the event of system failure or if for any reason, power is removed from the linear stepper motor 143. The motor lead screw 200 that passes through the linear stepper motor 143 may comprise threads. The linear stepper motor 143 contains a nut 153 surrounding the threads. The motor 143 rotates the nut 153 to raise or lower the cam shaft 112 and, therefore, the conical cam 80. When power is removed from the linear stepper motor 143, a fail safe brake 154 locks the nut 153 into a fixed position.

The manual override 76, comprise an adjustment knob 155 disposed on the exterior of the peristaltic pump housing 24. A detent 156 prevents the knob 155 from rotating unless a rotational force, such as that manually exerted by a pump user, is applied to the knob 155. If the knob 155 is rotated, the detent 156 will audibly click allowing the pump user to track the number of times the knob 15 has been turned. Alternatively or additionally, the detent 156 may allow the pump user to tactiley track the number of times times the knob 155 has been turned by decreasing the resistance a pump user detects towards the end of a knob 155 rotation. Each knob rotation is set to correlate to an amount that the conical cam 80 has been displaced, either upwards or down. The audible clicks or resistance decreases, therefore, allow the pump user to track the degree to which the tubing occlusion has been adjusted.

The adjustment knob 155 comprises a shaft 157 that connects to a first pulley 158. Turning the knob 155 rotates the shaft 157 and the first pulley 158. The first pulley 158 engages a timing belt 160 which in turn rotates a second pulley 162. The second pulley 162 rotates a spline shaft 164 that is fixed to the end of the motor lead screw 200. Rotating the motor lead screw 200 in this manner, when the internal linear stepper motor nut 153 is locked into a fixed position, will displace the cam shaft 112 upward or downward depending on the direction the lead screw 200 is rotated. Additionally, the fail safe brake 154 will maintain the lead screw 200 in its preset position, should power be removed from the system, preventing the release or change in the degree of occlusion until it is manually adjusted.

Figure 12:
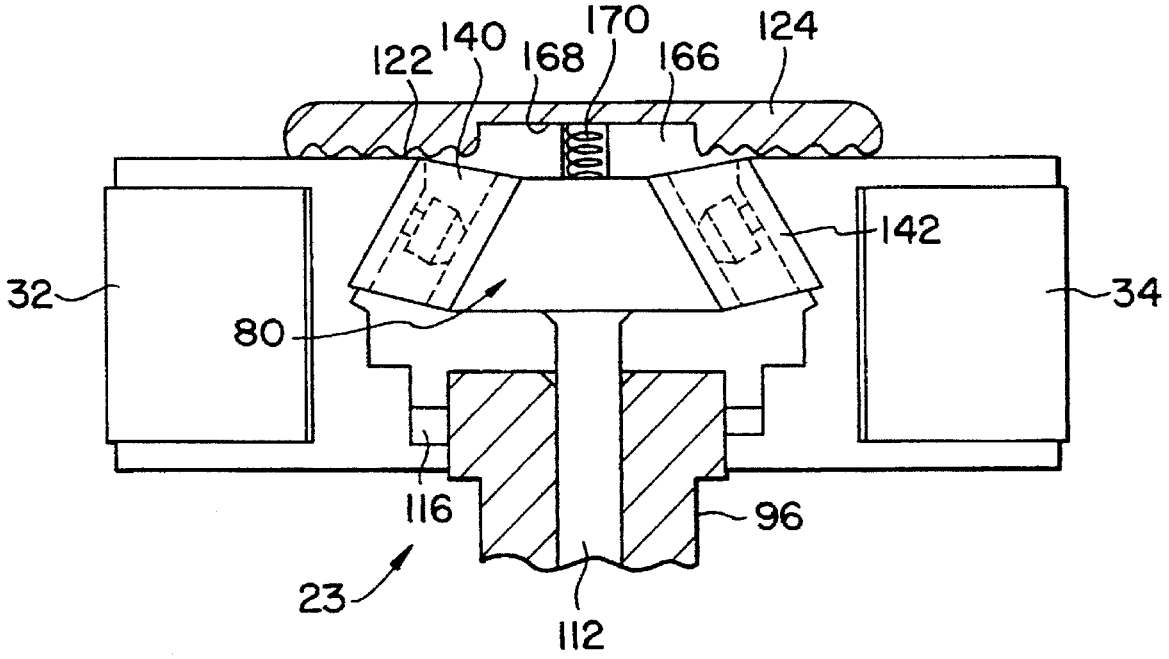
FIG. 12 front cross sectional view of the spring mechanism for down loading the conical cam in the first preferred embodiment of the present invention.

Referring next to FIG. 12, a rotor cap 124 defines a central cavity 166 between the conical cam 80 and the cap bottom 168. A compressive spring 170 may be fixed to the cap bottom 168 and conical cam 80 in cavity 166. The compressive spring 170 exerts pressure on the conical cam 80 and cam shaft 112 of the occlusion adjuster 23, to hold the occlusion adjuster 23 firmly in position against the thrust bearing 148. The compressive spring 170 also may act to force the conical cam 80 downward in the event of system failure, thereby fully retracting roller elements 32, 34 and releasing any occlusion in tubing loop 28.

Figure 13:
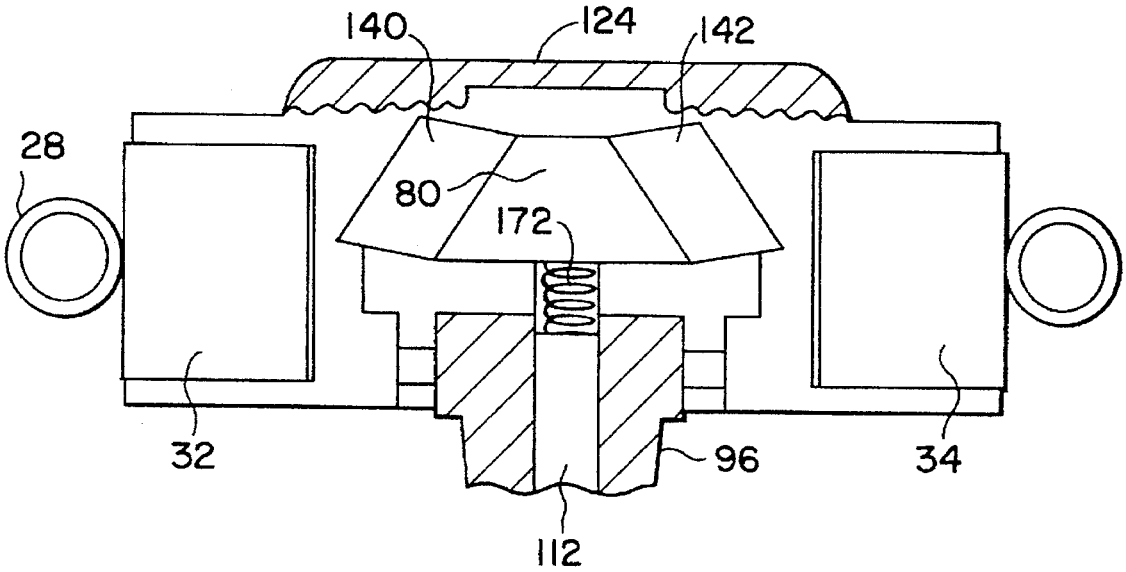
FIG. 13 is a front sectional view of the spring mechanism for up loading the conical cam of the first preferred embodiment of the present invention.

Alternatively, a compressive spring 172, as depicted in FIG. 13, may be mounted between the conical cam 80 and the cam shaft 112, thereby spring loading the conical cam 80 upward. The linear actuator 72 may, therefore, pull the conical cam 80 downward to adjust the degree of occlusion. In the event of a system failure, the linear actuator 72 may be released from the cam shaft 112. As a result, the force of the compressive spring 172 may force the conical cam 80 upward towards the rotor cap 124, thereby forcing the roller elements 32, 34 outward fully occluding the tubing loop 28.

All pump components are constructed of corrosion resistant material to prevent pump damage in the event that the tubing 28 bursts.

Operation

In operation, fluids flow into the inlet 42, through the tubing loop 28, into the shunt 50, where it is constructed of tubing, and the outlet 46, filling up the entire fluid flow path between the inlet 42 and the outlet 46. A fluid loop coupled with the excitation coil 52 and the sensing coil 54 is thereby formed.

Figure 14:
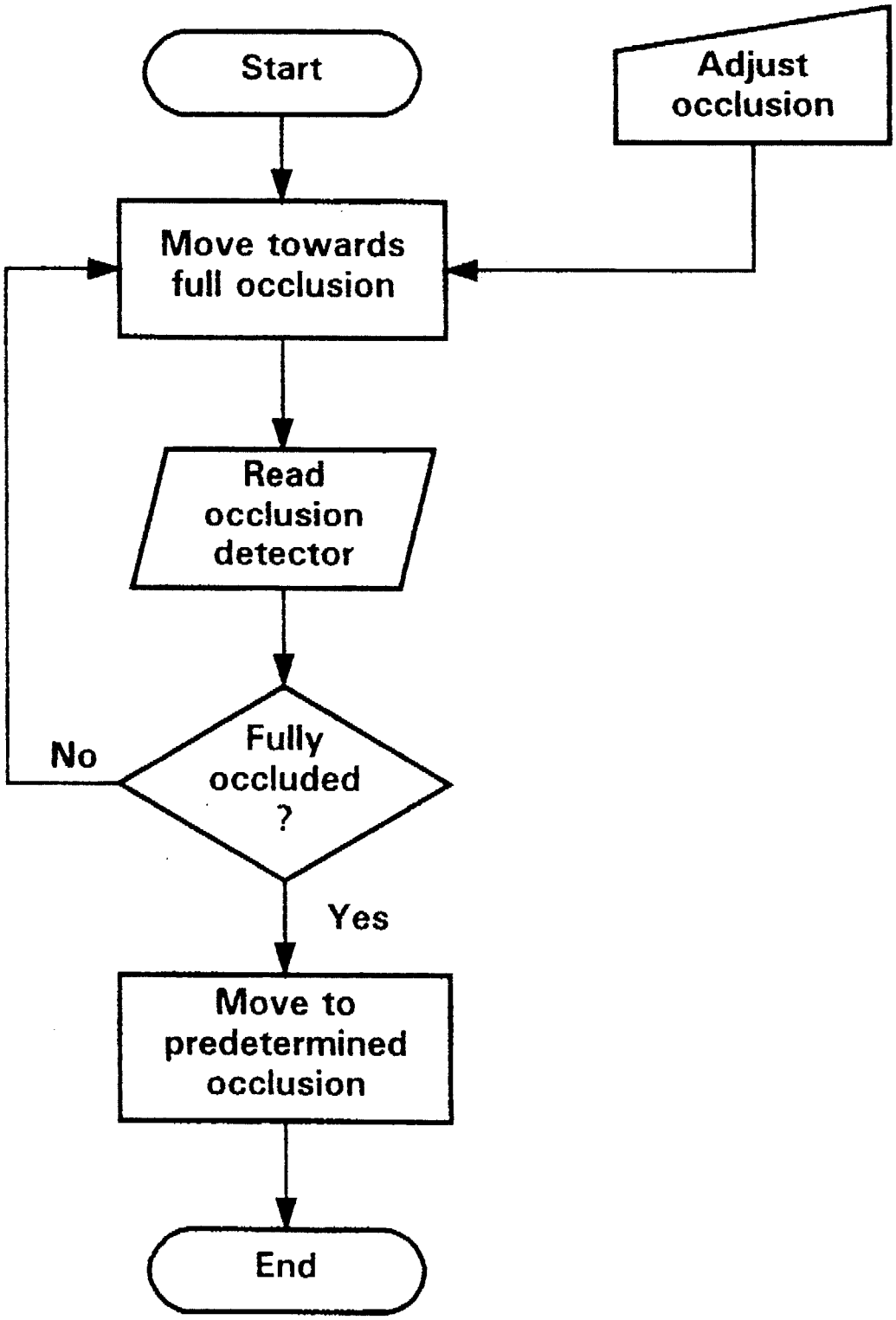
FIG. 14 is a flow chart illustrating the method by which a desired degree of occlusion is set in the present invention.

To set a desired degree of occlusion, the steps outlined in the flow chart of FIG. 14 are followed. The occlusion adjuster 23 is displaced upward as denoted by the direction arrow 150 towards the rotor cap 124 by the linear actuator 72 until full occlusion is detected. Full occlusion is detected when a remote occlusion detector 22 detects a large reduction in the fluid circuit conductance 66. The linear actuator 72 may be controlled either manually or by a controller 68.

Once full occlusion is detected in the tubing loop 28, the linear actuator 72 may be engaged to displace the conical cam 80 downward as denoted by the direction arrow 152 by a distance predetermined to result in a degree of occlusion predetermined to be appropriate for the procedure being run. The remote occlusion detector 22 continues to monitor the circuit conductance 66 throughout the course of the procedure.

In the first preferred embodiment, the controller 68 will adjust the position of the conical cam 80 if an occlusion amount that is outside a preset optimal range is detected. In the event of a system failure, desired degrees of occlusion may be maintained by the following mechanisms or a combination thereof. Occlusion may be manually adjusted by a manual override 76 that varies the position of the conical cam 80. The conical cam 80 may also be spring loaded upward or downward. When the conical cam 80 is spring loaded upward, full occlusion is maintained if the system fails or the power is lost for any reason. When the conical cam 80 is spring loaded downward, occlusion is completely released if the system fails or the power is lost for any reason.

In an alternate manual embodiment, the circuit conductance may be displayed throughout the procedure. If an occlusion amount is detected outside a preset optimal range an alarm may sound and a pump user may adjust the degree of occlusion using the manual occlusion adjuster 85. While the invention has been shown and described with respect to a specific embodiment thereof, this is intended for illustration rather than limitation, and other variations and modifications of the specific device shown will be apparent to those skilled in the art all within the intended spirit and scope of the invention. Accordingly, the patent is not to be limited in scope and effect to the specific embodiments shown and described herein, nor in any other way that is inconsistent with the extent to which the progress in the art has been advanced by the invention.

I claim:

1. An apparatus for determining a degree of occlusion of a peristaltic pump for pumping an electrically conductive fluid, said pump comprising a flexible tube having a first tube location and a second tube location separated from the first tube location and at least one tube occluder which occludes the tube between the first and second tube locations, the apparatus comprising:

an electrical connector which electrically connects the first tube location to the second tube location to create a closed electrical circuit comprising conductive fluid within the flexible tube between the first tube location and the second tube location and the electrical connector;

a source of periodically changing electrical current;

an electric current sensor;

an excitation coil inductively coupled to the closed electrical circuit at an excitation location and electrically connected to the source of periodically changing electrical energy; and a sensing coil inductively coupled to the closed electrical circuit at a sensing location separated from the excitation location and electrically connected to the electric current sensor.

2. The apparatus of claim 1 wherein the electrical connector comprises a connector tube in fluid communication with the flexible tube at the first tube location and at the second tube location.

3. The apparatus of claim 1 wherein the electrical connector comprises a metallic connector that is electrically connected to conductive fluid in the flexible tube at the first tube location and at the second tube location.

4. The apparatus of claim 1 wherein the excitation coil surrounds the flexible tube at the excitation location.

5. The apparatus of claim 1 wherein the sensing coil surrounds the flexible tube at the sensing location.

6. The apparatus of claim 1, further comprising an occlusion adjuster which adjusts the degree of occlusion in the tube.

7. The apparatus of claim 6, further comprising a controller in communication with the electric current sensor and the occlusion detector.

8. The apparatus of claim 7, wherein the controller adjusts the degree of occlusion in the tube in response to the determined degree of occlusion.

9. The apparatus of claim 6, wherein the occlusion adjuster comprises a manual adjustment mechanism.

10. The apparatus of claim 8, wherein the occlusion adjuster further comprises a manual override.

11. The apparatus of claim 8, wherein the occlusion adjuster further comprises a compressive spring for adjusting the degree of occlusion if power is removed from the apparatus.

12. The apparatus of claim 9, further comprising an occlusion indicator for indicating the degree of occlusion in the tube.

13. The apparatus of claim 12, further comprising an alarm for alerting a pump user when a predetermined degree of occlusion is exceeded.

14. A method for determining a degree of occlusion of a peristaltic pump for pumping an electrically conductive fluid, said pump comprising a flexible tube having a first tube location and a second tube location separated from the first tube location and a tube occluder which occludes the tube between the first and second tube locations, the method comprising:

filling the flexible tube with a conductive fluid;

electrically connecting the first tube location to the second tube location to create a closed electrical circuit comprising the conductive fluid within the flexible tube between the first tube location and the second tube location;

inducing a current at an excitation location; and sensing the current induced in the closed electrical circuit at a sensing location separated from the excitation location.

15. The method of claim 14 wherein the filling and electrically connecting steps further comprise filling a connector tube which is in fluid communication with the flexible tube at the first location and the second location with the conductive fluid.

16. The method of claim 14 wherein the inducing step further comprises:

providing a source of periodically changing electrical current; and inductively coupling the periodically changing electrical current to the closed electrical path.

17. The method of claim 14 wherein the sensing step further comprises:

inductively coupling to the electrical current in the closed electrical path at the sensing location to generate a sensed current; and measuring the magnitude of the sensed current.

18. The method of claim 14 wherein the sensing step further comprises:

interpreting the current induced in the closed electrical path as indicative of the conductance of the closed electrical path.

19. The method of claim 18 wherein the sensing step further comprises:

interpreting the conductance of the closed electrical path as indicative of a degree of occlusion of the flexible tube by the occluder.

20. The method of claim 14, further comprising:

adjusting the degree of occlusion of the flexible tube by the at least one occluder.

21. The method of claim 20, wherein the adjusting step further comprises:

increasing the degree of occlusion of the flexible tube by the at least one occluder;

detecting when full occlusion is reached;

decreasing the degree of occlusion of the flexible tube from full occlusion to a predetermined degree of occlusion.

22. A peristaltic pumping apparatus for pumping an electrically conductive fluid comprising:

a raceway for receiving a flexible tube having a first tube location and a second tube location separated from the first tube location the flexible tube having an electrical connector which electrically connects the first tube location to the second tube location to create a closed electrical circuit comprising conductive fluid within the flexible tube between the first tube location and the second tube location and the electrical connector;

at least one tube occluder which occludes the tube between the first and second tube locations;

a source of periodically changing electrical current;

an electric current sensor;

an excitation coil inductively coupled to the closed electrical circuit at an excitation location and electrically connected to the source of periodically changing electrical energy; and a sensing coil inductively coupled to the closed electrical circuit at a sensing location separated from the excitation location and electrically connected to the electric current sensor.

23. The apparatus of claim 22, wherein the excitation coil surrounds the flexible tube at the excitation location.

24. The apparatus of claim 22, wherein the sensing coil surrounds the flexible tube at the sensing location.

25. The apparatus of claim 22, further comprising a means for adjusting a degree of occlusion in the flexible tube while the apparatus is pumping.

26. A tubing set for use in a medical procedure comprising:

a flexible tube having a first tube location and a second tube location separated from the first tube location, the flexible tube being adapted for use in a peristaltic pump having at least one tube occluder which occludes the tube between the first and second tube locations; and an electrical connector which electrically connects the first tube location to the second tube location to create a closed electrical circuit comprising conductive fluid within the flexible tube between the first tube location and the second tube location and the electrical connector when it is desired monitor occlusion.

27. The tubing set of claim 26, wherein the electrical connector comprises a connector tube, which maintains electrical conductance through the electrical connector against unintended alterations while occlusion is being monitored, in fluid communication with the flexible tube at the first tube location and at the second tube location.

28. The tubing set of claim 26, wherein the electrical connector comprises a metallic connector that is electrically connected to conductive fluid in the flexible tube at the first tube location and at the second tube location.

29. The tubing set of claim 26, wherein the medical procedure is one of cardiovascular surgery, apheresis, dialysis or autologous blood salvage.

30. The tubing set of claim 26, wherein the fluid is blood and the tubing set further comprises devices for the treatment of blood.

31. The tubing set of claim 30, wherein the devices for the treatment of blood comprise at least one of a membrane exchange devices or a centrifugal separation device.

* * * * *